United States Patent [19]

Karlyk

[11] 4,260,366

[45] Apr. 7, 1981

[54] SELECTIVELY ACTUATABLE CANDLE IGNITER

[76] Inventor: Raymond Karlyk, 911 Cedar St., Boonton, N.J. 07005

[21] Appl. No.: 72,571

[22] Filed: Sep. 5, 1979

[51] Int. Cl.[3] ..... F23D 3/02

[52] U.S. Cl. ..... 431/298; 431/315; 431/299; 294/19 R; 294/100

[58] Field of Search ..... 431/315, 298, 299, 289, 431/290, 120, 300–304; 44/34, 35; 294/19 R, 100

[56] References Cited

U.S. PATENT DOCUMENTS

| | | | |
|---|---|---|---|
| 2,406,518 | 8/1946 | Urbank | 431/289 |
| 2,461,124 | 2/1949 | Muzzy | 431/289 |
| 2,722,816 | 11/1955 | Brautigan | 431/289 |
| 2,785,556 | 3/1957 | Smith | 431/290 |

*Primary Examiner*—James C. Yeung
*Attorney, Agent, or Firm*—Ralph R. Roberts

[57] ABSTRACT

There is disclosed a selectively actuated candle lighting or igniting apparatus particularly for use with candles whose wicks are within an enclosure. Such wicks are used to float on oil within glass bowls and the like. These candles may also be within hurricane-type enclosures or chimneys. Wicks, as a part of candles, are found in many table settings for both indoor and outdoor use. Many candle lighting devices have been proposed but generally wick lighters have been less than satisfactory since the wick members of these lighters generally accummulate wax and the wax softens and has a tendency to adhere to a tubular member within which it is drawn for extinguishing. The heat sink construction of the instant igniter prevents this problem.

10 Claims, 9 Drawing Figures

SELECTIVELY ACTUATABLE CANDLE IGNITER

BACKGROUND OF THE INVENTION

1. Field of the Invention

With reference to the classification of art as established by and in the United States Patent Office the present invention is found in the General class entitled, "Fuel and Igniting Devices" (Class 44) and in the subclass entitled, "fire kindling" (subclass 34) and also in t he subclass entitled, "apparatus", (subclass 35).

2. Description of the Prior Art

Candle lighting has been usually achieved by matches or other types of lighters, such as cigarette or cigar lighters. Such lighting of candles is quite satisfactory when the wick of the candle is exposed for close relationship to an igniter such as a match and the like. When the wick is floating on oil and is within a glass bowl or enclosure it is very difficult to light the wick by means readily available to the user of the candle. Most often this is the person who is attempting to set or make ready a table either indoors or outdoors. Often times hurricane-type enclosures or chimneys are used with candles in which the wick of the candle is below a convenient level for ignition by the use of a match and the like. Lighters have been tried but in their use they have proved less than satisfactory. Wick-type igniters are known but the snuffing of lighted wick within these igniters by the sliding of the tube often causes the wax on the wick to stick to the tube so that expelling of the wick at a later time is difficult or impossible.

In the present invention the igniter wick is carried by a holder and is replaceable in said interior holder. An outer tube is preferably made of metal with a relief formed near one end so that as the lighted wick of the igniter is drawn within the outer tube the wick end encounters a heat sink. This heat sink portion of this outer tube rapidly extinguishes this lighted wick and the cooling action formed by this heat sink is sufficient to rapidly cool the wax on the wick and prevent sticking of the wick within the outer tube.

SUMMARY OF THE INVENTION

This invention may be summarized in part with reference to its objects. It is an object of this invention to provide, and it does provide, a candle igniting device which has a wick holder adapted for the replacing of a wick within the holder and an outer tube is provided for the sliding of the wick holder within said tube. The tube has its outer tip formed as a heat sink which allows air to pass into the interior of this tube and cool the wick at its end while the ignited wick is extinguished.

It is a further object of this invention to provide, and it does provide, a candle igniter of inexpensive construction having a replaceable wick which is held by a chuck and ring. This ring is slid forwardly to secure a new wick held in a wick holder. This wick holder, as a unit, is slidable within an outer sleeve which has at least one notch formed near one end to provide a heat sink for the extinguishing and cooling of the wick. This wick when drawn within the end of the outer tubular member also provides rapid cooling of and on the wick so that the wax does not adhere to the outer tubular member.

In brief, this invention provides for a wick holder including a tubular member which normally has a fluted or grooved exterior surface. At one end this wick holder retains a chuck portion which has at least one lip formed thereon for the retention of the sliding ring. This sliding ring when moved to the rear of the wick holder allows the chuck portion to swing open sufficiently for the replacement of a new wick. The sliding forward of this ring closes the chuck sufficiently to grasp the wick so that it is retained in this wick holder. The wick holder is slidable within an outer tube having a notch formed midway or midportion for the easy manipulation of the wick holder forwardly and back in the outer tube. The forward portion of the outer tube is formed with at least one notch of a width approximately a half inch and with a depth sufficient to provide the heat sink by isolation of the tip from the rest of the outer tube.

In use the wick holder is manipulated so that the tip portion of the wick is caused to extend from the end of the outer tube at which time the extending end of this wick is lighted by a match or the like and this lighted wick is then manipulated into the container for lighting the floating or fixed candle. In these containers the wick is much below the top of the enclosure. This lighted device is utilized for the lighting of one or more candles and after all such candles or wicks have been lighted the user of the igniting device merely slides the lighted wick back into the outer tube end whereupon the heat sink end extinguishes the wick rapidly and efficiently and the heat does not travel to and within the outer tube.

In addition to the above summary the following disclosure is detailed to insure adequacy and aid in understanding of the invention. This disclosure, however, is not intended to cover each new inventive concept no matter how it may later be disguised by variations in form or additions of further improvements. For this reason there has been chosen a specific embodiment of an igniting device as adopted for use for lighting candles and the like and showing a preferred means for holding a wick in an interior movable holder. This specific embodiment has been chosen for the purposes of illustration and description as shown in the accompanying drawing wherein:

Figure 6:
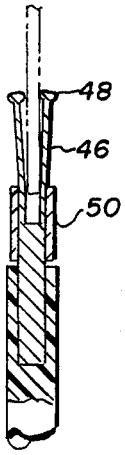
FIG. 6 represents an enlarged side view, partly fragmentary and in section, and showing a wick holder and the chuck provided therewith.

The drawing accompanying, and forming part of, this specification disclose details of construction for the purpose of explanation but structural details may be modified without departure from the concept and principles of the invention and the invention may be incorporated in other structural forms than shown.

DETAILED DESCRIPTION OF THE SELECTIVELY ACTUATABLE CANDLE IGNITER

Figure 1:
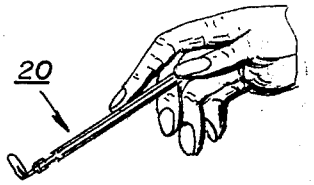
FIG. 1 represents a more or less diagrammatic side view representation of an igniter having a wick end pushed forward and lighted, with this igniter ready to be placed within a shrouded cnadle whose wick is much below the top of a chimney or container.
Figure 1:
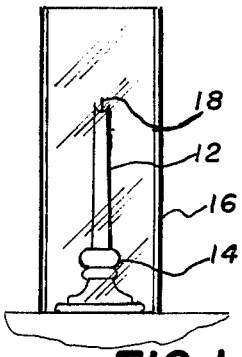

Referring now to FIG. 1, it is to be noted that a candle 12 is carried by a candle stick holder 14 and is protected conventionally from exterior breezes by an outer chimney or hurricane protector 16. In position the wick portion 18 of the candle 12 is ignited by the lighter device generally indicated as 20.

Figure 3:
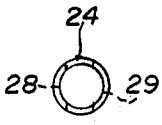
FIG. 3 represents an end view of the outer tube, this view taken on the line 3—3 of FIG. 2 and looking in the direction of the arrows.
Figure 2:
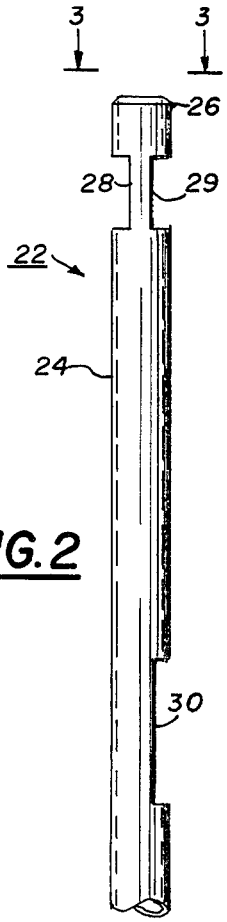
FIG. 2 represents an enlarged and partial side view of the tip end of the outer tube of the igniter.
Figure 8:
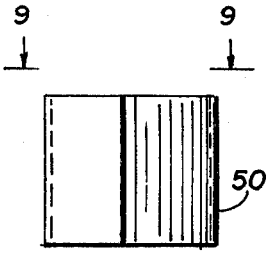
FIG. 8 represents a side view in greatly enlarged scale and showing a rolled sleeve as used in the construction of the chuck of FIGS. 6 and 7.
Figure 9:
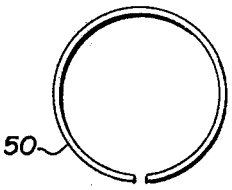
FIG. 9 represents an end view of the rolled sleeve of FIG. 8, this view taken on the line 9—9 of FIG. 8 and looking in the In the following description and in the claims various details are identified by specific names for convenience. These names are intended to be generic in their application. Corresponding reference characters refer to like members throughout the several figures of the one sheet of drawings.

Referring now in particular to FIG. 2, it is to be noted that the igniting device 20 includes an outer tube or sleeve generally indicated as 22 which is conventionally made from aluminum tubing 24. As reduced to practice, the tubular sleeve is a quarter inch in outer diameter with about a one thirty-second or thinner wall. The end of this tubing 24 is beveled at end 26 to form a smooth cutoff end. About one-quarter of an inch in from the end of this holder are formed opposed cutout portions 28 and 29. These cutouts as depicted are about one-quarter of an inch in from the beveled end 26 and may be about a half inch in length and about one-sixteenth of an inch in depth. This extending end portion is a full circle portion and with the opposed cutout portions 28 and 29 form a heat sink. About three to four inches from the opposed cutout portions 28 and 29 is formed an access notch 30 which extends into the one side of the outer tube 22 to form an access slot for a purpose to be hereinafter more fully described. In FIG. 3 is seen an end view of the outer tubular tube member 22 with the opposed cutout portions 28 and 29 shown in dashed outlines.

Figure 4:
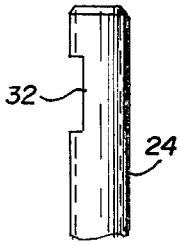
FIG. 4 represents a side view of an alternate construction of the outer tube like that of FIG. 2 with this outer tube having only one notch formed to provide a heat sink tip end portion.

Reference is now made to FIG. 4 in which the end depicted in FIG. 2 may be formed as a single access notch 30 in a length of tubing 24. This alternate construction shows that a single access notch 30 in the outer tubular portion 124 provides a heat sink in this outer tubular member. This is not the preferred embodiment, at least one but more than two slots can be provided to reduce the transfer of heat from the lighted wick to the grasping portion of the outer member. It is to be noted that in both FIGS. 2 and 4 the tubular member is shown as one-half inch in diameter whereas it is conventionally much less. A convenient size for manipulation and for cost is about one-quarter inch extruded aluminum tube with a stiff but thin wall.

Figure 5:
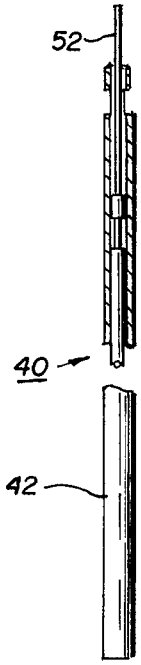
FIG. 5 represents a side view, partly in section, of the wick holder and the chuck as adapted for slidable use within the outer tube of FIG. 2.

In FIG. 5 it is to be noted that a wick holder 40 includes an aluminum tubular member 42 which may have its outside threaded, knurled or fluted to provide a slightly rough surface. Movable or slidable within the outer tubular member is a wick holder 40 which is a cylindrical aluminum tubular member 42 having a recess formed in one end. A wick holder 44 is a press fit or is glued into the aluminum tubular member 42 so that it is secured fixedly in place. The end recess formed in the wick holder member 44 provides chuck jaw members 46 which are preferably made of brass or similar easily shaped material. These chuck jaw members 46 are conventionally shaped into a tubular configuration with these jaws split so that only two chuck jaws are provided. A stop tab 48 may be provided on one or both jaw members and may extend inwardly and outwardly as desired.

A sleeve 50 is also formed into a ring and in place around the shank portion of the jaw member of the chuck 46. A length of wick 52 is brought into position in the chuck jaws 46 and the sleeve 50 is slid forward to lock and secure the wick 52 in the holder 40. The holder 40 with the secured wick 52 is now slid within the outer tube member 22 so that only a portion of the wick 52 extends beyond the beveled end chamfer 26. This extending wick portion 52 is not lighted and the candle wick 18 is brought to a lighted condition by advancing the flame within the confines of the chimney or hurricane protector 16.

USE AND OPERATION

The length of wick 52 is placed within the chuck jaw members 46. The sleeve 50 is then slid into position. The knurled or fluted portion of the aluminum tubular member 42 of the wick holder 40 is manipulated through the access notch 30 so that only about one-quarter of an inch of the wick extends beyond the beveled end 26 of the outer tube 22. A match is now brought to the wick 52 which is then lighted. This lighted wick of the igniter is moved to the floating wick or enclosed candle where the wick or candle is lighted. After the person or the attendant lighting the wick portions has lighted all the candles, the outer tube 22 is grasped at or near the access notch 30. The thumb or finger in notch 30 is manipulated to cause the wick 52 to be slid within the confines of the outer tube 22. The heat sink provided by the end portion snuffs the igniter wick 52 and extinguishes the flame. The wax on the wick is now cooled so that easy manipulation of the wick holder 40 in and out of the outer tube 22 is easily accomplished.

Figure 7:
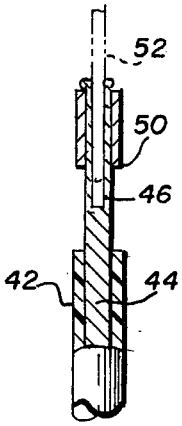
FIG. 7 represents a side view, partly in section and also in enlarged scale of the chuck end of the wick holder of FIG. 6 and showing the chuck sleeve slipped forwardly into a holding condition for the wick which is now shown in full outline.

The igniting apparatus above described and shown in the drawing contemplates that except for the replacable wick 52 that all portions will be made of fireproof or fire resistant material, probably metal. The outer tube 22 is preferably of extruded aluminum and for manipulative convenience is more than one-half inch but not less than three sixteenths of an inch in outer diameter. This tube has a thin wall such as one-thirty second of an inch but not more than one-eighth of an inch. The wick holder 40 is depicted as an aluminum tubular member 42 but this handle or member portion may be solid or of plastic having a very high resistance to flammability. The chuck shown in FIGS. 6 and 7 represents a preferred holder for the length of wick 52 but other mechanical arrangements can be used since the retainer chuck for a length of wick 52 is much like the chuck retainer for leads used in a mechanical pencil. The chuck shown in FIGS. 6 and 7 has the stop tabs or retainer portions 48 provided so as to prevent loss of the sleeve 50. If and when made on and by a four-slide machine only an outwardly extending tab may be formed. Whatever the configuration, it is anticipated that the chuck be made with fireproof components that are not easily lost or misplaced.

It is to be further noted that the notch for the heat sink is nominally one-half inch in length and is about one-quarter inch from the end of the outer tube 22. The notch may be as close as three sixteenths of an inch and the notch length may be as little as one-quarter inch and as much as one inch. The reduced longitudinal cross sectional area in this tube is sufficiently stiff to maintain the end of the outer tube in a desired alignment during continued use.

The preferred embodiment shows a second notch 30 but it is realized that this notch may be eliminated and the wick holder 40 be made sufficiently long so that manipulation may be achieved by the manipulating of that portion of the holder extending beyond the outer tube and opposite the end containing the heat sink. The igniter device must have only a sufficient length to comfortably advance a lighted wick end into an enclosure.

Terms such as "up", "down", "bottom", "top", "front", "back", "in", "out" and the like are applicable to the embodiments shown and described in conjunction with the drawing. These terms are merely for the purposes of description and do not necessarily apply to the position in which the candle igniter may be constructed or used.

While a particular embodiment of the igniter and an alternate embodiment has been shown and described it is to be understood the invention is not limited thereto since modifications may be made within the scope of the accompanying claims and protection is sought to the broadest extent the prior art allows.

What is claimed is:

1. A selectively actuatable wick lighting apparatus which is adapted to be manipulated so as to provide an extended wick end which may be lighted and when lighted provides a long slender wick igniter which may be extended into an open top of an enclosure device to light a "hard to reach" wick, said apparatus including:

(a) an outer tube of noncombustionable material and of slender configuration and having a relatively thin wall;

(b) at least one notch formed in said side wall of the outer tube and close to one end of the tube, this notch extending inwardly from the outer surface to form a substantially reduced longitudinal cross section area and providing therewith a heat sink area and means;

(c) a forward grasping portion provided by the outer tube and extending at least a distance of at least four inches from the heat sink end of the outer tube;

(d) a wick holder sized so as to be slidable within the outer tube and having a wick end member removably secured in said holder, this holder having a body portion of a length sufficiently greater than this forward grasping means so that this body portion of the wick holder may be engaged by the user to manipulate the holder to bring the retained wick end outwardly to an exposed condition whereupon this wick end may be lighted and this lighted wick may be manipulated into the enclosure to light the wick of the candle after which the lighted wick is removed from the enclosure and by manipulation the wick holder is moved sufficiently into said outer tube to bring the lighted wick into the heat sink area whereat the lighted wick end is extinguished by the close proximity of said tube, this heat sink preventing unwanted heat from the now extinguished wick end to travel from the end of the outer tube to its grasped midportion, and (e) a chuck carried in and by the wick holder and adapted to grasp and removably retain a wick end portion in the end of said holder.

2. A selectively actuatable wick igniting apparatus as in claim 2 in which the outer tube has a second notch formed in the side wall of the outer tube, this second notch located midlength of the outer tube and providing a manipulative access opening into said tube, and through this access opening the body portion of the wick holder is engaged by a digit of the user so as to manipulate the holder to a wick end exposed condition and later to move the wick end to an extinguishing condition.

3. A selectively actuatable wick igniting apparatus as in claim 2 in which the outer tube is of extruded aluminum of not more than one-half inch and not less than three sixteenths of an inch outer diameter and having a wall thickness of not more than one-eighth and not less than one-thirty secondth of an inch in thickness.

4. A selectively actuatable wick igniting apparatus as in claim 2 in which there are two opposed notches formed in the outer tube and forming a heat sink at one end of the outer tube.

5. A selectively actuatable wick igniting apparatus as in claim 4 in which the opposed notches are disposed from three sixteenths to three-eighths of an inch from the end of the outer tube and the notches are from three-eighths to three-quarters of an inch in length.

6. A selectively actuatable wick igniting apparatus as in claim 5 in which the second notch in the side of the outer tube is at least three-quarters of an inch in length and is at least three inches from the end of the outer tube containing the heat sink.

7. A selectively actuatable wick igniting apparatus as in claim 2 in which the wick holder is made of extruded aluminum tubing and the outer diameter of said tubing is slightly smaller than the internal diameter of the outer tube so as to be easily slidable in the internal diameter of the outer tube.

8. A selectively actuatable wick igniting apparatus as in claim 2 in which the wick holder is made of plastic having a resistance to combustion, this holder having an outer diameter which is slightly smaller than the internal diameter of the outer tube so as to be easily slidable in the internal diameter of the outer tube.

9. A selectively actuatable wick igniting apparatus as in claim 2 in which the outer surface of the body of the wick holder is made sufficiently rough to enable ease of digit manipulation through said second notch.

10. A selectively actuatable wick igniting apparatus as in claim 2 in which the chuck is made with two extending jaw members formed into a circular tube-like configuration and with at least one jaw member formed with a stop tab adapted to limit the forward travel of a sleeve carried on the outer portion of the chuck jaw members.

* * * * *